US005246469A

United States Patent [19]

Arfelli et al.

[11] Patent Number: 5,246,469

[45] Date of Patent: Sep. 21, 1993

[54] FUEL STABILIZATION

[75] Inventors: William Arfelli, Avondale Heights; Alan Power, Keilor; Richard Solly, Ascot Vale, all of Australia

[73] Assignee: The Commonwealth of Australia, Canberra, Australia

[21] Appl. No.: 183,188

[22] PCT Filed: Jul. 24, 1987

[86] PCT No.: PCT/AU87/00235

§ 371 Date: Feb. 29, 1988

§ 102(e) Date: Feb. 29, 1988

[87] PCT Pub. No.: WO88/00914

PCT Pub. Date: Feb. 11, 1988

[30] Foreign Application Priority Data

Jul. 25, 1986 [AU] Australia ..... PH07128

[51] Int. Cl.[5] ..... C10L 1/30; C10L 1/16

[52] U.S. Cl. ..... 44/384; 44/389; 44/417; 44/418; 44/419; 585/2; 585/3; 585/4; 585/823; 585/824; 585/830

[58] Field of Search ..... 44/51, 384; 585/2, 3, 585/4, 823, 824, 830

[56] References Cited

U.S. PATENT DOCUMENTS

| | | | |
|---|---|---|---|
| 2,306,870 | 12/1942 | Engelhardt | 44/51 |
| 4,032,510 | 6/1977 | Floyd et al. | 585/2 |
| 4,339,246 | 7/1982 | Yamamura et al. | 44/51 |
| 4,659,334 | 4/1987 | Matlach | 44/51 |

FOREIGN PATENT DOCUMENTS 1341693 12/1973 United Kingdom .

*Primary Examiner*—Ellen M. McAvoy

*Attorney, Agent, or Firm*—Roylance, Abrams, Berdo & Goodman

[57] ABSTRACT

Distillate fuel is stabilized against degradation during storage by inserting into storage tanks solid materials containing polar sites to enable polar condensation of the fuel constituents active in degradation. Polyether or polyester polyurethane open cell foams are the prime solid stabilizers proposed.

10 Claims, 5 Drawing Sheets

FUEL STABILIZATION

Figure 1:
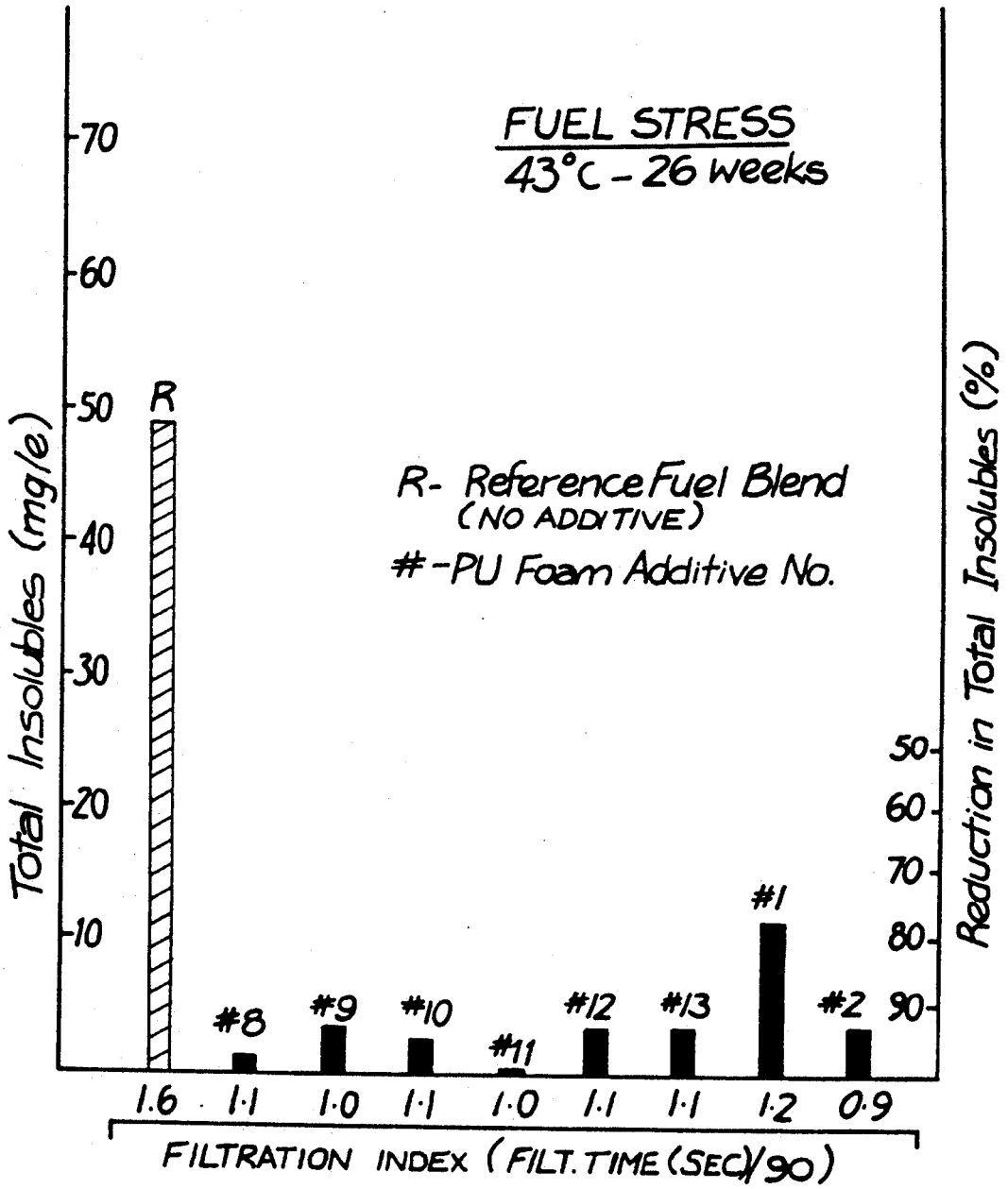

This invention relates to a method and means of preventing degradation in liquid hydrocarbon fuels.

Some liquid fuels particularly distillates are stored in static storages for periods of up to several years.

Over extended periods of time, small but significant changes in fuel properties can occur. Important properties which change with time are colour and insolubles content. Insoluble materials can plug fuel system filters, reduce or alter the fuel flow through engine nozzles and form sludges in the fuel tanks. Formation of insolubles is an indication of chemical reactions in a fuel. Chemical degradation of fuels is an important aspect of fuel stability.

Storage stability of distillate fuels has been of modest concern for fuels made by refining processes based on straight run distillation. However, increasing quantities of heavy crudes and distillation fractions are being run in refineries using cracking processes to increase the yield of middle distillate fuels. The cracked products, which contain chemically unstable species, are blended into straight run streams. The unstable components, although diluted by the blending, still exert a strong influence on insoluble material formation, particularly for long storage periods.

Stabilizing additives have been proposed to reduce the extent of insoluble material formation in middle distillate fuels. Specific additives, such as phenylenediamines and hindered phenols, have been used. These additives have been found to be effective in preventing the formation of gums in gasolines and peroxides in jet fuels. They have been shown to be ineffective in preventing the formation of particulate matter in distillate fuels.

Additive manufacturers' experience with diesel fuels and home heating oils has led them to recommend alkyl amines as stability additives. These effective additives contained alkyl amines, some in conjunction with a metal deactivator (MDA). These observations were made on several straight run distillates as well as 30% blend of catalytically cracked stock (light cycle oil—LCO) in a stable straight run fuel.

U.S. Pat. No. 3,701,641 proposes to stabilise distillate fuels against degradation using a polyamine having 2 to 6 amino groups and 25 to 50 carbon atoms.

Cyclohexylamines have been proposed as distillate fuel stabilizers in U.S. Pat. Nos. 3,640,692, 3,336,124 and 4,040,799 and in French Patent 1441717.

It is an object of this invention to provide a simple alternative means to stabilizing fuels.

To this end the present invention provides a method of stabilizing liquid hydrocarbon fuels which comprises storing the fuel with solids capable of removing from fuel those active elements which catalyse or participate in the degradation reactions.

These insoluble solid additives reduce the amount of fuel degradation material which is suspended in the fuel or deposited on the walls of the container. The solid additives useful in this invention are thought to contain polar sites to enable polar condensation of the active constituents to occur. A solid additive with this capability acts as a preferred deposition site for molecules of insoluble material, and for precursors of insoluble material in the fuel. These precursors are partitioned between the solid additive and the fuel molecules. Reduction of the concentration of these precursors in the fuel reduces degradation of the fuel.

Application of solid additives to the interior of fuel system components for fuel stabilization can be in the form of cellular foams, sponges, mesh, woven fabric, naturally entwined or bound fibre bundles, surface coatings, strips, films, or solids such as powders or particulate material encapsulated in fuel permeable containers. Preferred foams are open cell polyurethane foams or polymeric foams including urea, carbamate, ester or amide groups available as polar sites.

Polyurethane (PU) foam is a solid which possesses high fuel stabilization performance when immersed in fuel during storage. These polymers comprise large numbers of well defined polar functional groups which have affinity for unstable components in the fuel. The partition of unstable precursors between solid and fuel strongly favours their depletion from the fuel to the foam.

Fuel degradation material is also deposited on the foam surface, rather than forming as suspended particulate matter in the fuel.

When polyurethane foams are employed it is generally preferred to use polyether based polyurethanes because of their greater stability in avoiding degradation by hydrolysis but in some cases polyester based polyurethanes will be quite suitable due to their better stability in fuels containing higher levels of aromatic hydrocarbons.

The method of this invention can be carried out either as a pre-storage treatment or by inserting the foams into storage tanks. Generally the foams are present in a concentration of at least 0.01% weight by volume with a preferred concentration of 1 to 5 g. per litre of fuel.

By passing the fuel through a bed of solids as taught by this invention or through an open cell foam, the stability of the fuel is improved and its storage life extended. This is particularly useful with distillates which are highly susceptible to degradation.

Generally however it is preferred to incorporate the solids or foams into fuel storage tanks. The foams are preferably open cell in structure and have a porosity which ensures that the volume of fuel displaced is low but still provides a large surface area for fuel contact.

A number of comparison tests of accelerated ageing of distillate fuels have been carried out to quantify the fuel stabilizing effect of a wide range of PU foam samples.

Figure 2:
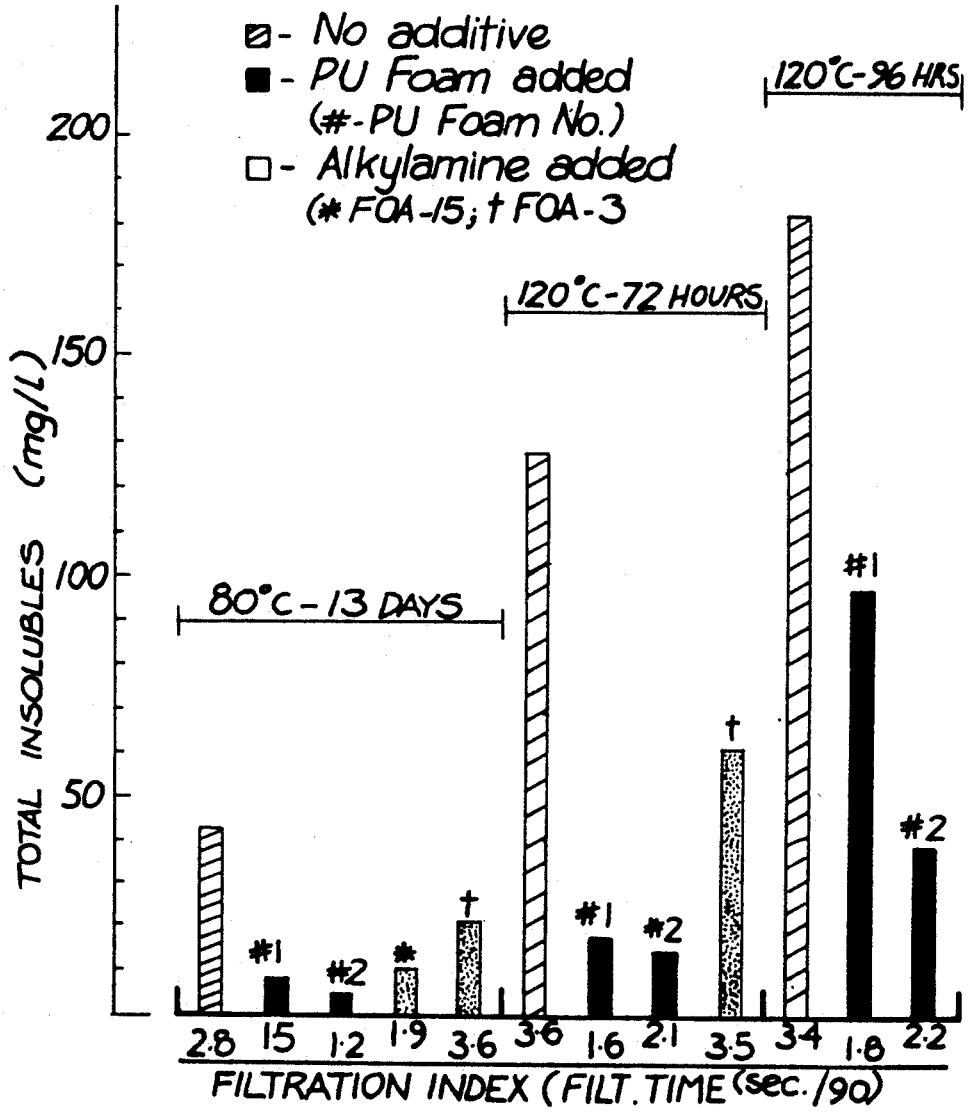
Figure 3:
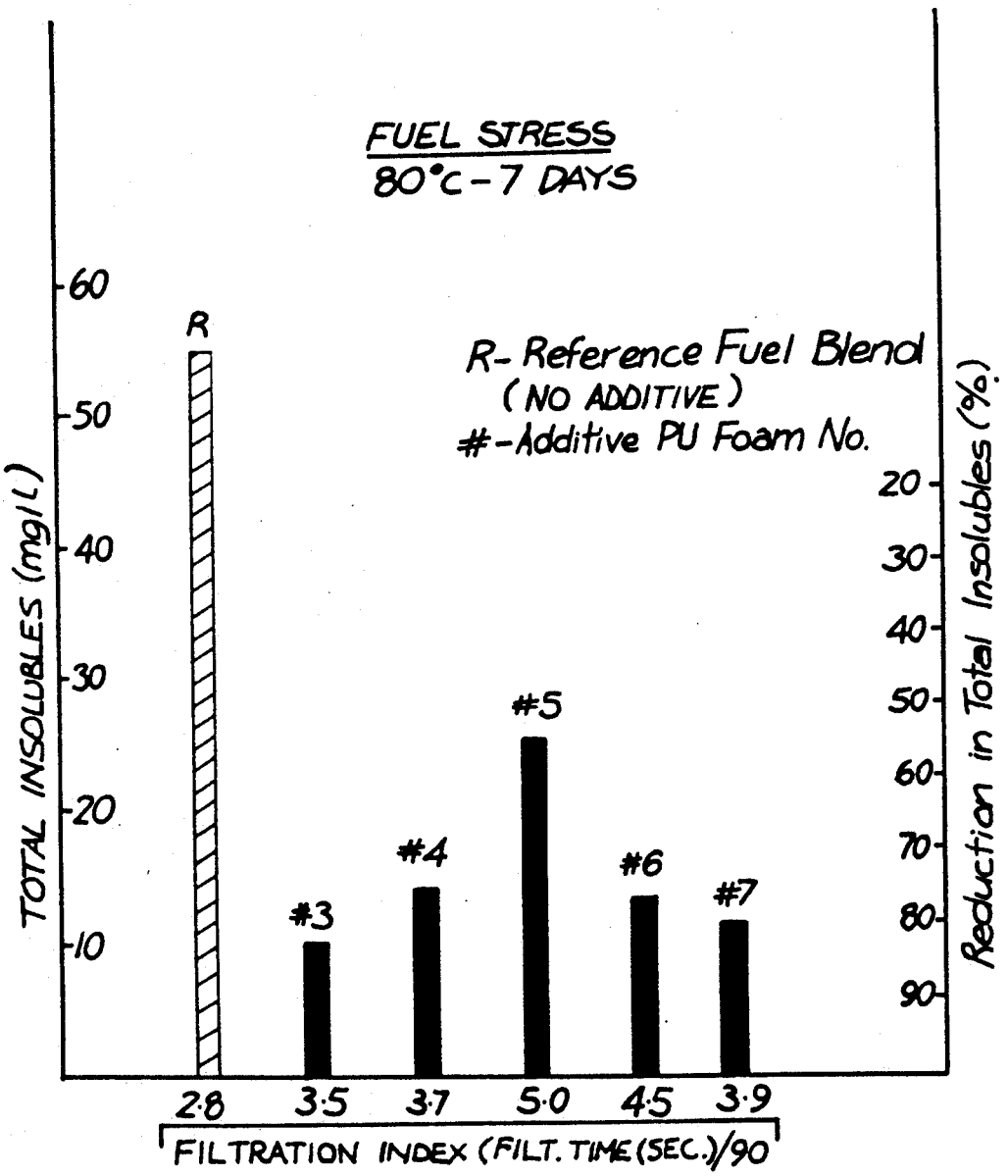
Figure 4:
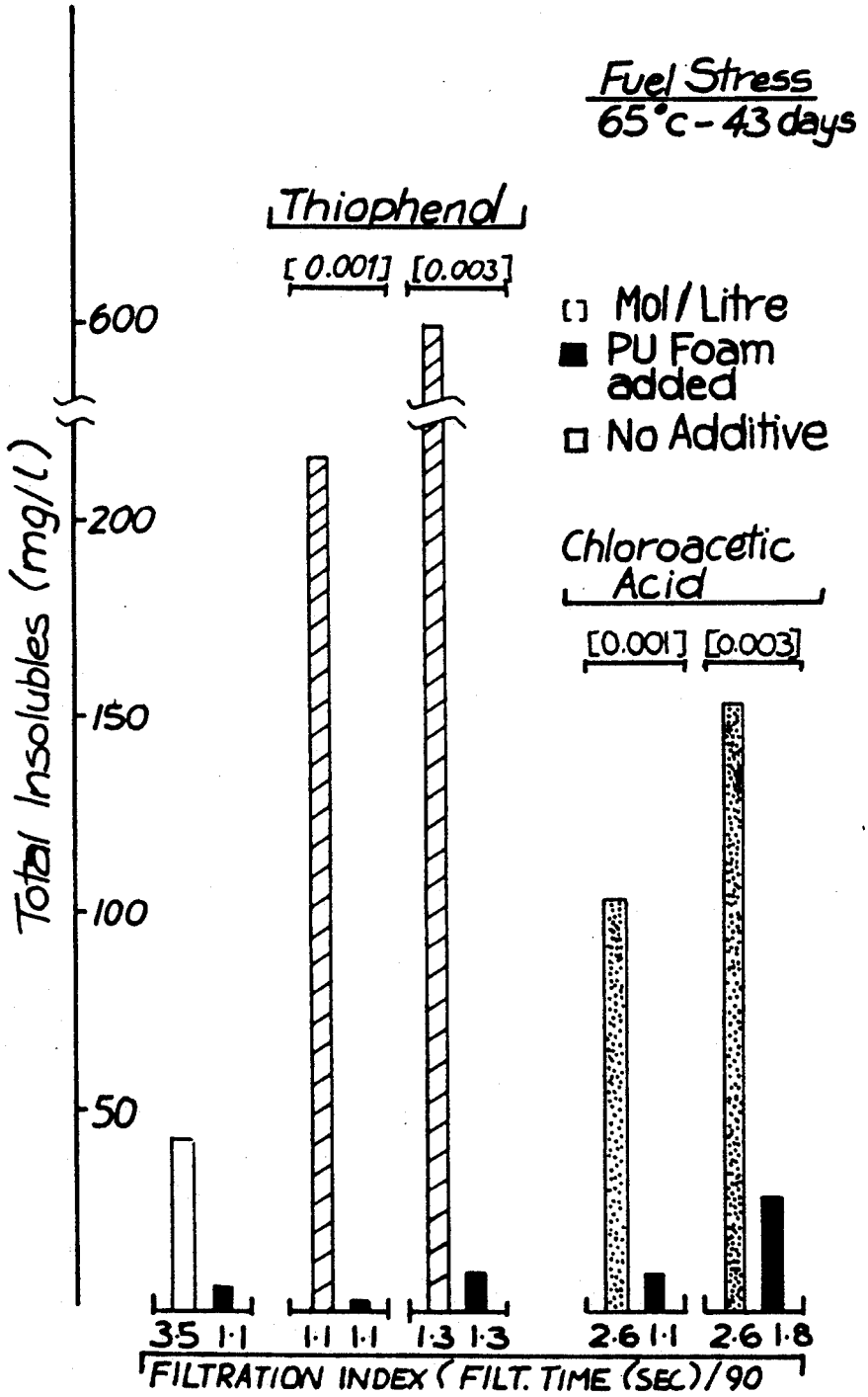
Figure 5:
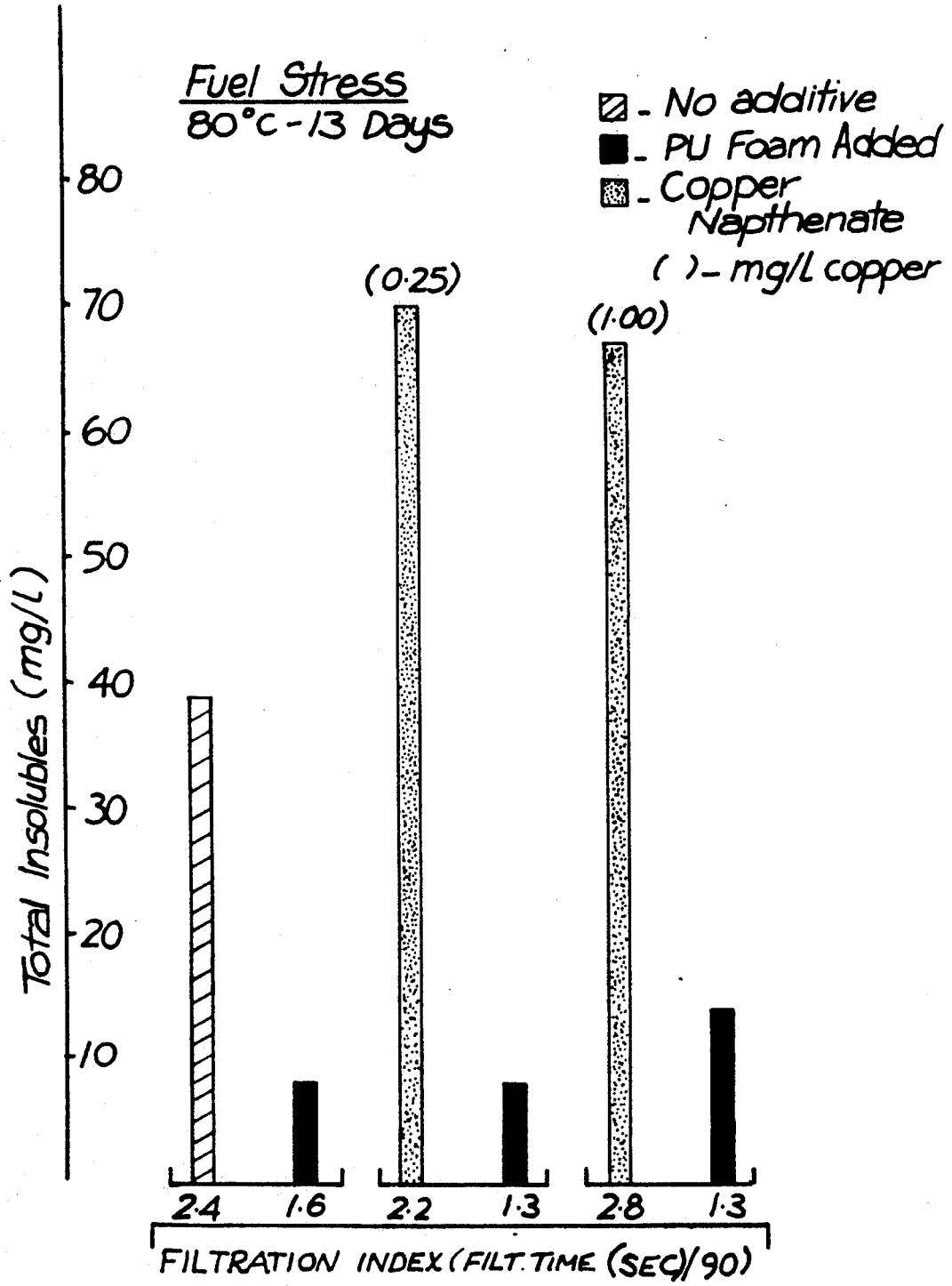

The test results are illustrated in FIGS. 1 to 5 which in graph form, provide comparisons between fuel ageing in the presence of a range of foams listed in table 1 and compared in FIGS. 1 to 3 with reference fuel samples while FIGS. 4 and 5 illustrate the effect of PU foams on fuels containing fuel deposit promoters.

TABLE 1

| PU Foam No* | Cell Type | Polyol Type | Code | Air Flow ($m^3/h$) |
|---|---|---|---|---|
| #1 | *Ca* | Ether | PE850 | N.D.[c] |
| #2 | *Rb* | Ester | ME020 | N.D |
| #3 | R | Ester | ME010 | 38.1 |
| #4 | R | Ester | ME015 | 40.9 |
| #5 | C | Ester | EF430 | 0.5 |
| #6 | C | Ether | PE900 | 2.5 |
| #7 | C | Ether | HR940 | 8.0 |
| #8 | R | Ester | ME020 | N.D. |
| #9 | R | Ester | ME030 | 26.4 |
| #10 | R | Ester | SFI | N.D. |
| #11 | R | Ester | SFII | N.D. |
| #12 | R | Ester | SFIII | N.D |

TABLE 1-continued

| PU Foam No* | Cell Type | Polyol Type | Code | Air Flow ($m^3/h$) |
|---|---|---|---|---|
| #13 | R | Ether | SFIV | N.D. |

Classification of PU Foams used in Fuel Stabilization Experiments.
[a]C = closed-cell foam structure
[b]R = reticulated (open-cell) structure
[c]N.D. = not determined
*Foams #1-9 were manufactured by Cable Makers Australia
Foams #10-13 were manufactured by Scotfoam, U.S.A.

The polyester foams 2, 3, 4, 8 & 9 contain modified poly(diethylene glycol)adipate with a density of 28 $kg/m^3$ and a cell count of 5 to 30 pores perlinear centimetre.

The polyether foams 1,5,6 & 7 contain poly(oxypropyl)

poly(oxyethyl) glycerol and have a density of 27 $kg/m^3$ and 15 to 25 pores per linear centimetre.

Foam 13 contains an acrylonitrile-styrene modified polyoxyalkylene polyether resins.

A range of polyether and polyester PU foams were tested as stabilizing additives for (light cycle oil/-straight run distillate) fuel blends during storage for various time intervals, in the temperature range 43°-120° C. Intervals of storage at ambient temperature, approximately equivalent to specific experimental accelerated fuel stressing conditions used in this work, were calculated to be as follows:

| Fuel Stress (Temp - Time) | Ambient Temperature Equivalent (Years) |
|---|---|
| 43° C. - 6 months | 2.0 |
| 65° C. - 43 days | 2.3 |
| 80° C. - 13 days | 1.9 |
| 80° C. - 14 days | 2.0 |
| 120° C. - 72 hours | 6.9 |
| 120° C. - 96 hours | 9.2 |

FIGS. 1, 2, 4 and 5 show the amounts of total insolubles formed from the same fuel blend during fuel ageing for five different time intervals at three different temperatures.

In all fuel stressing trials, duplicate samples of the respective fuel blends without additives were carried through all procedures, for comparison with duplicate sample blends containing additives. In some experiments, known fuel destabilizing agents (deposit promoters) were added in conjunction with PU foam additives in order to determine the efficiency of PU foam in counteracting the effects of these agents on fuel stability.

The degree of degradation of fuel blends under the various experimental conditions was determined by measurements of parameters considered to be relevant to fuel instability :

| | |
|---|---|
| (i) Particulate matter<br>(ii) Adherent Gum | = Total Insolubles (mq/l) |
| (iii) Filtration Index<br>(iv) Colour (ASTM D1500) | |

Where applicable, changes in mass of the PU foam additives after ageing were also measured. Soluble gum concentrations, by ASTM D381, have been shown to have only a tenuous link 10 with quantitative measurements of fuel instability.

The Filtration Index [(iii) above] is the ratio by which the filtration time (sec) of an aged fuel, with or without additive, exceeded the filtration time (sec) of the prefiltered, unaged fuel blend, under a standardized method of pressure filtration (29 kPa; 4.2 p.s.i.) through Whatman No.540 cellulose fibre membranes with nominal pore size of 8.0 micron. For the filtered, unaged reference fuel, replicate determinations showed good reproducibility (±5%), with the average filtration time being 90 sec. For the aged fuels, however, reproducibility of filtratation times for some duplicate samples was not as good as for the unaged fuel. Factors such as formation of variable-sized particulate matter during ageing of duplicate samples, and non-uniformity in peformance of the nominal pore size filter membranes with filtration of contaminated liquids, may have contributed to variations, sometimes as much as ±20%, for aged fuel duplicates. In most cases, however, variations were <±10%.

Filtration times for aged-fuel duplicates were averaged and converted into the above Filtration Index for semi-quantitative filterability evaluation. Aged fuels with Filtration Index between 1.0 and 1.3 were considered to have "good" filtration characteristics, between 1.3 and 2.0 "fair", and greater than 2.0 were considered "poor".

Mild accelerated ageing of fuels at 43° C. is widely accepted as being the most realistic and accurate test for estimation of the long term stability of diesel distillates during bulk storage. The data in FIG. 1, therefore, are considered to be representative of the performance of PU foam fuel stabilizing additives under field conditions Ageing at 43° C. generally requires relatively long trial periods (at least 13 weeks) for significant changes in the fuel to occur. The data in the FIG. 1 was obtained after 26 weeks fuel ageing at this temperature, a period equivalent to about two years ambient storage.

The effectiveness of the PU foams for fuel stabilization is clearly demonstrated in FIG. 1. Total insolubles and particulate levels were very low, close to experimental detection limits for those parameters, indicating very high fuel stability compared to the aged reference fuel Polyether foam #1 underwent slight physical disintegration during protracted fuel immersion, with visible foam cell fragments contributing to the particulate components, thus increasing total insolubles. This foam, however, was the only foam in this trial which was not designed specifically for fuel immersion. The latter group showed unaffected structural integrity.

Filtration Index values (FIG. 1) for all fuels aged with PU foams indicated "good" filterability, equivalent to, or approaching that for the clean, unaged reference fuel (1.0). The aged reference fuel had a significantly higher Filtration Index of 1.6.

Improvement in colour of aged fuel blends in presence of PU foams was greatest for ageing periods less than the equivalent of 6 months at ambient temperature.

Colour differences between fuel containing PU foams and aged reference fuel decreased as the period of ageing increased.

Greater colour stability of aged fuel was achieved when the foam/fuel weight/volume ratio was of the order of 5 g per litre. Foams #9, #14, #15 and #16 (Table 2) were effective in suppressing colour degradation compared to the reference fuel after ageing for periods of up to 48 hours at 120° C. (equivalent of 4.6 years storage at ambient temperature). The ageing period is shown in hours in Table 2. The fuels aged with foam, which showed improved colour stability, also had greatly reduced formation of insolubles and improved filterability as seen in Table 2.

TABLE 2

| Foam No. | Foam Type | Foam g/L | Colour 15 hrs | Colour 39 hrs | Colour 48 hrs | Insolubles mg/L 48 hrs | Filtration Index 48 hrs |
|---|---|---|---|---|---|---|---|
| | NONE | — | 4.0 | 5.0 | 5.0 | 21 | 4.8 |
| #9 | ME030 | 3.8 | 3.0 | 3.5 | 3.5 | 2 | 1.1 |
| #14 | SFV | 4.8 | 2.0 | 2.0 | 2.5 | 3 | 1.0 |
| #15 | SFVI | 5.6 | 2.5 | 2.5 | 2.5 | 2 | 1.2 |
| #16 | SFVII | 5.1 | 2.5 | 2.5 | 2.5 | 2 | 1.1 |

Foam #9 was manufactured by Cable Makers Australia, and Foams #14, #15 and #16 by Scottfoam, USA.

Colour was determined by ASTM DE1500. The colour of the unaged fuel was 2.0.

Very low levels of total insolubles, combined with good filtration characteristics and colour stability are properties not normally associated with aged distillates which contain 30% unhydrotreated LCO. The above data, therefore, demonstrate that fuel-immersible PU foams exert a strong stabilizing influence on distillate fuel.

Under the experimental fuel ageing conditions shown in FIGS. 2 and 3, each of the PU foam samples selected for evaluation imparted significant improvement to fuel stability. The level of total insolubles was reduced in almost all cases by more than 50%, generally by more than 70%, and in some cases by greater than 80%.

FIGS. 2 and 3 also show no apparent discrimination between polyether or polyester PU foams with respect to their fuel stabilizing properties at the experimental fuel foam ratios.

The physical form of the foams possibly exerted a small influence on fuel stabilization efficiency. Foams 2, 3 and 4 were reticulated (open cell) types with high permeability to gases (air flow $>30\ m^3h^{-1}$) and therefore, presumably, to liquids. Each of these foam samples gave at least a 75% reduction in total insolubles, compared to the reference fuel. Foams 1, 5, 6 and 7 were closed cell PU foams. Total insolubles reductions for foams 1, 6 and 7 were comparable to those of the reticulated foams; however, foam #5 (FIG. 3), which had a much lower air flow ($0.51\ m^3h^{-1}$), gave a relatively poor reduction (55%) in total insolubles. The low permeability of this foam may have reduced free access of fuel to the interior of the sample during ageing, lowering overall fuel/foam contact, thus affecting its fuel stabilizing influence. It may be noted that difficulty was experienced in removing residual fuel from this sample, even after hexane rinsing, and heating (115° C.) in a vacuum oven. This also was attributed to the very low permeability of the foam.

Ageing of the fuel blend in the presence of foams #1 and #2 (FIG. 2) clearly had a beneficial effect on aged fuel filterability. Filtration Index values for the 80° C.—13 day fuel stress data for the foams are in the "good" to "fair" categories, while the reference fuel Filtration Index indicates "poor" filterability. Similar results were obtained for the 120° C. data, even though for foam #1, the particulate measurement was boosted by foam fragments from thermal decomposition of the foam.

Filtration Index values shown in FIG. 3, however, indicate "poor" filterability for all fuel samples, whether aged with or without added PU foams. Particulate levels were much lower for fuels aged in the presence of foams, but their filter blocking tendencies appear to be worse than for the reference fuel. The two sets of filtration data in FIGS. 3 and 4 cannot be compared directly, since different fuel stressing conditions were used. It has been observed previously that filtration characteristics of fuels can be worse after shorter term than longer term ageing at the same temperature. This may be related to changes in particle sizes of fuel deposits with time.

The performance of PU foams 1 and 2 for fuel stabilization was compared with that of fuel soluble additives FOA-3 and FOA-15 (FIG. 2). In a previous study, using a similar fuel blend, reductions in total insolubles in the range 50–70% were achieved when FOA-3 was added at a concentration of 24 ppm. At the same concentration, this additive effected reductions in total insolubles of 55% for the fuel blend used in the present study, a result significantly lower than that achieved with the immersed PU foams (>80% reduction). The Filtration Index was also quite high in comparison.

The FOA-15 additive, however, gave total insolubles reduction comparable to those effected by the PU foams, although the Filtration Index of 1.9 was significantly higher. This may have been due to the presence of the dispersant component in FOA-15, which has been demonstrated previously to adversely affect aged fuel filterability. It was concluded from this study that the PU foams were at least as effective as these fuel-soluble additives in suppressing distillate fuel degradation during ageing.

The effectiveness of PU foam as a fuel stabilization additive was examined using fuel blend doped with known deposit promoters thiophenol, chloroacetic acid and copper naphthenate.

Addition of thiophenol to the fuel blend, at concentrations of 0.001M and 0.003M, caused increases in total insolubles from 43 mg/l, for the undoped fuel, to 217 and 600 mg/l, respectively, during fuel ageing at 65° C. for 43 days (FIG. 4). Very large increases in adherent gum levels were observed; the very low relative levels of particulate matter (2 mg/l, or less) were consistent with Filtration Index values which indicated "good" filterability. Thus, filterability evaluation in this case was not an indication of actual fuel stability.

Dramatic reductions in total insolubles were achieved when PU foam samples were immersed in the solutions of thiophenol in the fuel (FIG. 4). The magnitude of insolubles reduction (>98%) indicated that the powerful deposit promoting activity of thiophenol had been completely counteracted by the PU foam additive.

Filtration Index values of the fuel aged with the thiophenol/foam combination rated "good" in the filterability classification.

It may be seen from FIG. 4 that similar results were obtained using solutions of chloroacetic acid (0.001M and 0.003M) in the fuel blend. Respective increases in total insolubles of 2.4 and 3.6 fold at the two acid concentrations were not as large as those for thiophenol solutions (5.0 and 14.0 fold). Immersed PU foam additives effectively counteracted the destabilizing effect of the chloroacetic acid, although not quite to the same degree observed for the thiophenol solutions. The acid had a much greater tendency than the thiol to increase the proportion of particulate matter, relative to adherent gum, and this was reflected in the "poor" filterability rating for fuel aged with acid alone. In combination with PU foam additive, particulate was reduced by >80% for the acid/fuel solutions, and improved Filtration Index values were observed (2.6:1.1 for 0.001M solution, 2.6:1.8 for 0.003M solution).

Addition of copper (as copper naphthenate) to the reference blend at a concentration of 0.25 mg/l caused an increase in total insolubles from 39 mg/l (with no additive) to 70 mg/l, during ageing at 80° C. for 13 days (FIG. 5). The catalytic effect of copper in promoting deposit formation was not enhanced when the copper concentration was increased to 1.00 mg/l. The ratio of particulate to adherent gum which formed in the presence of copper was about 4:1, compared to about 2:1 for chloroacetic acid, again much greater than that for thiophenol. Filtration Index values for the fuel aged with copper present did not increase, relative to the aged reference fuel.

Ageing of the 0.25 mg/l solution of copper in fuel with PU foam additive decreased total insolubles formation by 89%. The actual amount of total insolubles formed (8 mg/l) was the same as when the reference fuel (with no copper added ) was aged with PU foam, indicating that the deposit forming action of the copper had been fully counteracted by the foam. With the 1.00 mg/l copper solution, the foam was slightly less effective, giving an 81% reduction in insolubles. However, the excellent performance of PU foam as a copper deactivator is evident. Significant improvements in Filtration Index values were also achieved when the copper solutions were aged with PU foam samples (FIG. 5).

Polyolefin solids which are capable of acting as preferred deposition sites for molecules of insoluble material, and which possess an affinity for precursors of insoluble material in fuel, showed fuel stabilization properties. The active sites arise from heteroatom functional groups or the addition of polar additives such as Ciba-Geigy Tinuvin 770, Tinuvin 622 and Chimassorb 944.

Knitted high density polyethylene cloth, impregnated with 0.45 weight percent of polymeric hindered amine light stabilizers containing 2,2,6,6-tetramethylpiperidine moieties (Tinuvin 622 and Chimassorb 944) were immersed for 12 days at 80° C. in a fuel blend similar to that described above. Total insolubles were 11 mg/l, compared to 58 mg/l for the fuel aged with no additive, a reduction of 81%. Filtration Index values for these aged fuel samples were 1.6 and 4.5, respectively. Polypropylene, and high and low density polyethylene without the polar copolymer additives were ineffective as fuel stabilizers, giving no reduction in total insolubles compared to the reference fuel in the above experiments.

Thus, the use of polyolefin solids, in conjunction with polar copolymers, has been successfully demonstrated for fuel stabilization.

Woven Kevlar [poly(1,4-phenylene terephthalamide)] cloth, nylon 6—6 cord and polyester fibres showed fuel stabilization properties when immersed in the test fuel (14 days, 80° C.) containing 0.001 mol/l chloroacetic acid (deposit promotor). The reference fuel without additive produced 97 mg/l of total insolubles whereas that produced in fuel aged in the presence of the above materials were 45, 50 and 8 mg/l, respectively.

Synthetic and natural fibrous materials were found to be fuel stabilizers with respect to fuel colour, before and after fuel ageing for 7 days at 80° C. It can be seen from Table 3 that the fibrous materials reduced fuel colour readings by 0.5–1.5, compared to the aged reference fuel with no additive. Under controlled laboratory conditions of fuel ageing, colour reductions of this order in comparative tests, using the same fuel blend, indicate significant reductions in the amounts of insoluble fuel degradation products. Evaluation of these solid additives by this means has illustrated their effectiveness as fuel stabilizing additives.

TABLE 3

| Trade Name of Fibre | Fibre wt. (g/l) | Polar Chain Functional Groups | Aged fuel Colour (ASTM D1500)[a] |
|---|---|---|---|
| DACRON 45 | 4.5 | ESTER | 3.0 |
| ORLON 75 | 2.0 | ACRYLONITRILE | 3.0 |
| NYLON 6-6 | 1.6 | AMIDE | 2.0 |
| COTTON | 1.9 | HYDROXYL; ETHER | 2.5 |
| WOOL | 1.7 | AMIDE; CYSTINE | 2.0 |
| RAYON | 3.8 | ACETATE | 3.0 |
| (BLANK FUEL) | — | — | 3.5 |

[a]Initial fuel colour: 1.5
Fuel Stress: 80° C., 7 days

This invention is applicable to all distillate fuel tanks, including static storages, vehicle fuel tanks and aircraft fuel tanks.

Adoption of the present invention provides the following advantages:

(i) Insoluble solid additives possessing the properties described, when inserted in fuel systems provide a continuously efficient, passive environment for minimising the effects of fuel instability during storage.

(ii) Such solids have the capability of maximising storage stability of very unstable fuels containing cracked refinery stock. This is significant, since refineries world-wide are increasing the proportion of cracked stock into middle distillates.

(iii) Less demand would be placed upon expensive refinery hydrotreating, or the use of fuel stability additives, for fuel systems which incorporated suitable solid additives.

(iv) Solids such as polyurethane foams, polyester fibre and Kevlar cloth are stable and non-toxic to handle. No precautions are required in their use. This may be contrasted with chemical additives, which are generally toxic and require protective equipment to be handled in their concentrated form.

It is envisaged that the fuel stabilizing system of this invention will find the following application:

(a) For insertion in Defence fuel systems and strategic installations where there is a requirement to protect fuel from chemical degradation (most Defence materiel has this requirement).

(b) For use in vehicle fuel tanks in which the deterioration of distillate fuel may occur due to chemical ageing. This includes commercial diesel powered vehicles, diesel powered rural equipment and marine and air craft.

(c) For use in storage tanks of all sizes in which distillate fuel is kept for any length of time, when degradation products are likely to increase in concentration and cause malfunction in equipment when subsequently used.

The claims defining the invention are as follows: We claim:

1. A method for minimizing the chemical degradation of a liquid hydrocarbon distillate fuel during storage for an extended period of time, said liquid hydrocarbon distillate fuel containing cracked products derived from a heavy crude or distillation fraction, said cracked products including chemically unstable species that promote fuel degradation upon storage for an extended period of time leading to a build-up of insoluble particulate material, comprising the step of storing said hydrocarbon fuel in contact with a polymeric solid which is capable of removing or counteracting fuel components catalyzing or participating in degradation reactions and which is selected from the group consisting of polyurethane foam, polyolefin fiber, polyacrylonitrile, cotton, wool, and polyacetate, whereby the amount of said chemically unstable species in said liquid hydrocarbon fuel is reduced.

2. The method according to claim 1, wherein the polymeric solid is in the form of cellular foam, sponge, mesh, woven fabric, naturally entwined or bound fiber bundles, surface coatings, strips, films, or solids encapsulated in a fuel-permeable container.

3. The method according to claim 1, wherein the polymeric solid is an open-cell polyurethane foam.

4. The method according to claim 1, wherein the polymeric solid is a polyether-based polyurethane foam.

5. The method according to claim 1, wherein the polymeric solid is a polyester-based polyurethane foam and the liquid hydrocarbon fuel contains aromatic hydrocarbons.

6. The method according to claim 1, wherein the polymeric solid is a polyurethane foam based on poly(diethylene glycol) adipate or poly(oxypropyl) poly(oxyethyl) glycerol or on an acrylonitrile-styrene modified polyoxyalkylene polyether resin.

7. The method according to claim 1, wherein the polymeric solid is a polyethylene cloth containing heteroatom functional groups or polar additives.

8. The method according to claim 1, wherein the polymeric solid is poly(1,4-phenylene terephthalamide) cloth.

9. The method according to claim 1, wherein the polymeric solid is a polyurethane foam and the method of storing the hydrocarbon fuel in contact with the polymeric solid is by adding the polymeric solid to a storage tank containing the fuel in an amount of 1 to 5 grams of polyurethane foam per liter of fuel.

10. A method for minimizing the chemical degradation of a liquid hydrocarbon distillate fuel during storage for an extended period of time, said liquid hydrocarbon distillate fuel containing cracked products derived from a heavy crude or distillation fraction, said cracked products including chemically unstable species that promote fuel degradation upon storage for an extended period of time leading to a build-up of insoluble particulate material, comprising the step of contacting said hydrocarbon fuel with a polymeric solid which is capable of removing or counteracting fuel components catalyzing or participating in degradation reactions and which is selected from the group consisting of polyurethane foam, polyolefin incorporating a polar copolymer, polyamide, Nylon 6—6, polyester fiber, polyacrylonitrile, cotton, wool, and polyacetate, whereby the amount of said chemically unstable species in said liquid hydrocarbon fuel is reduced.

* * * * *